United States Patent [19]

Hogan

[11] 3,950,888

[45] Apr. 20, 1976

[54] HOMOHEDRAL MODULE

[76] Inventor: John P. Hogan, 704 Elm, Williamsburg, Iowa 52361

[22] Filed: Oct. 29, 1974

[21] Appl. No.: 518,529

[52] U.S. Cl. ..... 46/25
[51] Int. Cl.[2] ..... A63H 33/08
[58] Field of Search ..... 46/24, 25; 35/39, 72

[56] References Cited

UNITED STATES PATENTS

| | | | |
|---|---|---|---|
| 1,809,508 | 6/1931 | Colby | 46/25 |
| 3,708,910 | 1/1973 | Skillman | 46/25 |
| 3,728,201 | 4/1973 | Stroehmer | 46/24 |

*Primary Examiner*—Louis G. Mancene
*Assistant Examiner*—Robert F. Cutting

[57] ABSTRACT

The module is a geometric toy block that is designed to imitate the icosahedron's unique ability for three-dimensional intersection with another icosahedron so that a pentangular co-planar line segment that defines the convex pentangular co-planar edge on each icosahedron is shared by both along with a ten faced convex polyhedron.

14 Claims, 5 Drawing Figures

HOMOHEDRAL MODULE

In my recent application, entitled Homohedral Construction (Ser. No. 502,839, filed 9/3/74), I described a new geometry involving a plurality of icosahedra and how they can either intersect with one another along established pentangular co-planar line segments to create a new three-dimensional convex figure, shared by both intersecting icosahedra, consisting of two clusters of five icosohedral faces forming two separate and opposite vertices which share a common pentangular perimeter edge along their co-tangent pentangular bases, or how they can be truncated by the removal of a cluster of five icosahedral faces which form a pentangular pyramid about a vertex and joined along the resulting planes of truncation, and in which the truncations or intersections occur about any single vertex, any two opposite vertices, any two non-adjacent and non-opposing vertices, or any three non-adjacent and non-opposing vertices on the individual icosahedron. The present invention is simply a convex-concave block which, when attached pentangular co-planar edge to another identical block or to an appropriate icosahedron block, imitates the icosahedron in its observance of this newly discovered geometry of either three-dimensional intersection or truncation-interconnection.

Immediate objects of the present invention are twofold: one is to provide children an curious adults with a whole new genre of geometric patterns and forms to play with, the other is to provide serious minded individuals, be they children or adults, with a new tool in uncovering the mysteries of geometric patterns as they occur in nature.

Further objects and advantages will become apparent in the following description of specific embodiments of this invention made in conjunction with the accompanying drawings in which.

Figure 1:
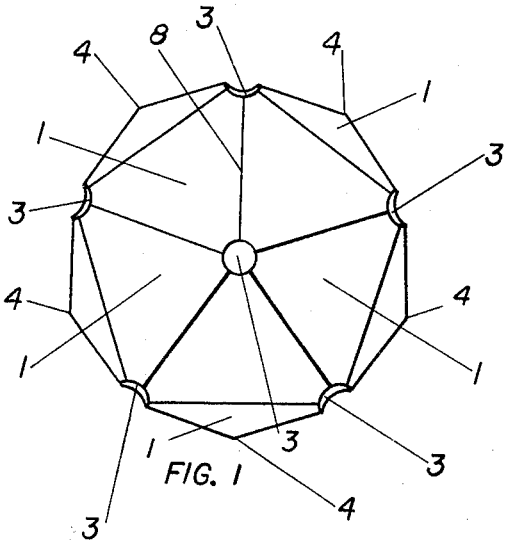
FIG. 1 is a top view of a homohedral module.
Figure 2:
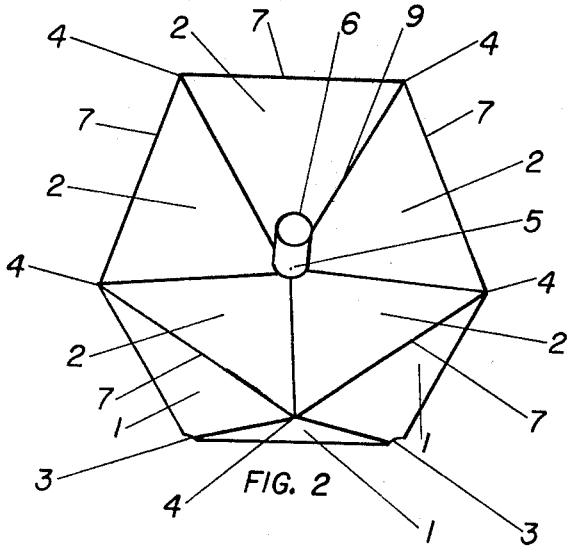
FIG. 2 is a bottom perspective view of a homohedral module.
Figure 3:
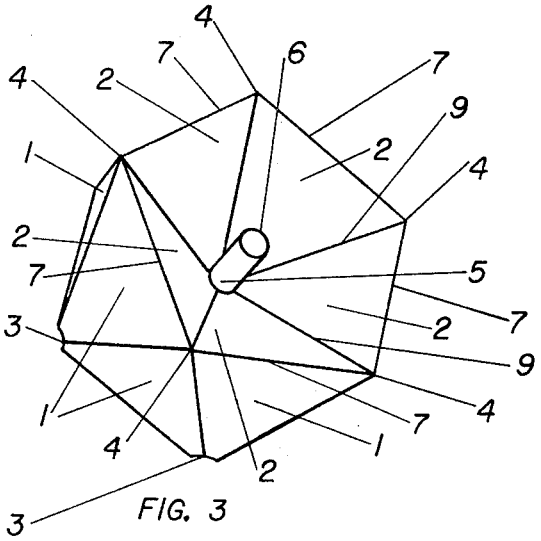
FIG. 3 is a perspective view of a homohedral module.
Figure 4:
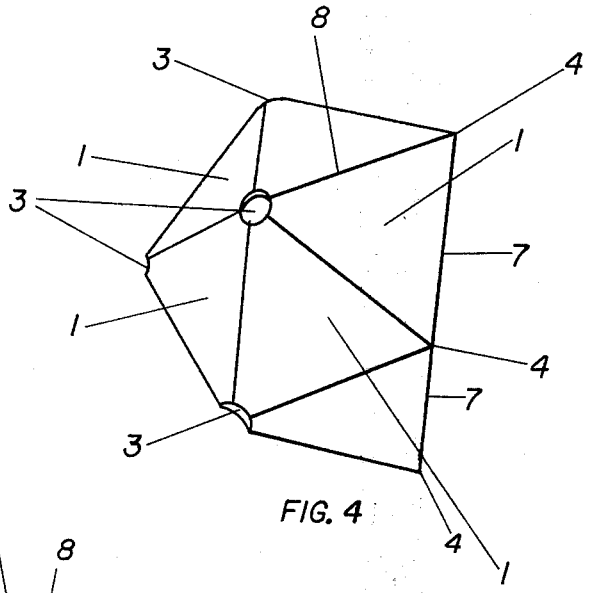
FIG. 4 is a side view of a homohedral module.
Figure 5:
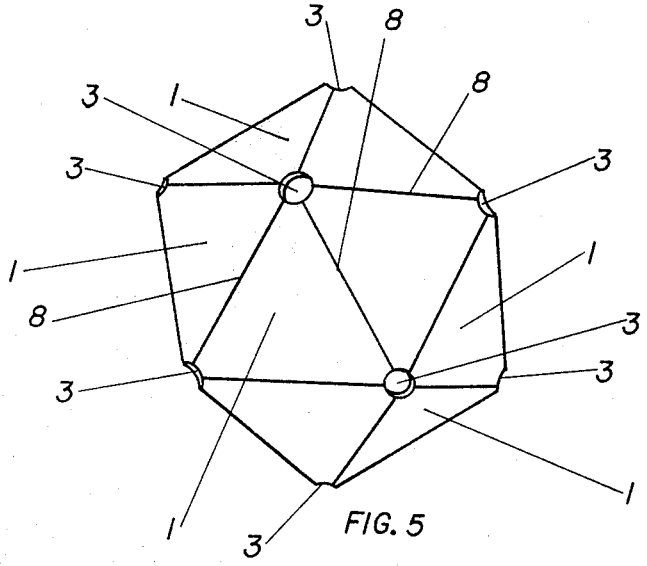
FIG. 5 is a side view of an appropriate icosahedron block to be used with a homohedral module.

In my preferred embodiment, particularly as seen in FIGS. 1–4 which show various views of the module, it can be seen that the module is composed of twenty planar faces 1 and 2 and 12 vertices 3, 4 and 5. Fifteen of the faces 1 are equilateral triangular in shape and are clustered in such a way that they produce 15 surface edges 8 and six surface vertices 3 among themselves that are identical to those found on the surface of a regular icosahedron when or where all edge and vertex angles are measured internally (see FIG. 5 for references). The remaining five faces 2 are uniform, though slightly isoceles triangular in shape and are clustered in such a way that they produce five surface edges 9 and one surface vertex 5 among themselves. The surface edges 9 are wholly concave and slightly smaller in dihedral angle, when measured externally, than the convex angle existing on the edge 8 between any two equilateral triangular faces. The surface vertex 5 is wholly concave and again slightly smaller in total angular deflection, when measured externally, than the convex vertex 3 existing amid a cluster of any five of the 15 equilateral triangular surface faces.

There are five additional edges 7 that are formed by the tangency of the five uniform bases of the concave isoceles triangular cluster with the five exposed equilateral triangular edges from the convex portion of the surface. These edges 7 form a pentangular co-planar line segment whose individual dihedral angles are convexly uniform with one another, but more acute than the dihedral angles present on any of the other 25 edges occurring on the solid, be they convex or concave. These five acute edges 7 are interconnected to one another through five co-planar vertices 4. The major identifying characteristic of these vertices 4 is their uniform convex-concavity. Lying as they do between sections of the module that are wholly convex and wholly concave, each of these five vertices have four convex 7 and 8 and one concave 9 edges radiating from each of them.

In my preferred embodiment of the module there are six connecting apertures present at the six respective convex vertices 3. The concave vertex 5 possesses a male connecting device at its center of such a length and diameter so as to fit into any of the six apertures on the surface of an identical module so as to hold the two modules together snugly when the five acute edges 7 of the one module are tangent with any five pentangular co-planar line segments formed by the convex edges 8 or 7 and 8 on the other module.

Variations on this preferred embodiment are possible and perhaps probable depending upon the type of manufacturing process that is used to produce it. In my preferred embodiment I assume that the module is made out of a plastic material that has been injection molded. But if the module were made out of solid pieces of wood, the concave portion of its surface might take on a different character being more concave and less faceted than it is in my preferred embodiment. Also the means of connection between any two modules or even a module and an analogous icosahedron might be through the use of dowel pins which are independent of the modules into whose convex and concave centered apertures they would be pressed. It should also be noted that even when, in my preferred embodiment, two pentangular co-planar line segments of two individual blocks are tangent, their enclosed surfaces are only proximate and not actually tangent. But there is no reason why in fact these surfaces couldn't be tangent. There is no overwhelming reason geometrically why they have to be proximate. I simply prefer them to be so.

An economical variation in the forming of the module would be for the convex surfaces and the pentangular co-planar mating edges to retain their structural integrity, but for the concave surfaces, as previoulsy described, to be non-existent and in their place simply a means of attachment, be it an aperture or preferably a male connecting device, centered exactly where the means of attachment would occur at the concave vertex in the preferred embodiment. In effect such a module would simply be a plastic shell with some protuberances or apertures depending upon the way it is looked at. It would certainly be less expensive to manufacture than a module which encloses space within its surfaces and therefore perhaps is the best suited for production.

The geometry that the module is designed to imitate or reproduce is unique in that it frequently closes in upon itself (has a topological genus of one). When this occurs only the module itself is needed in constructing the design. But where the structural design is open at two or more ends (has a topological genus of zero) a supplemental icosahedron block FIG. 5, with attachment apertures occurring at each of its vertices 3, is necessary to complete the homohedral design. Otherwise if only the module is used at one or more ends, there will be exposed the concave surface of a module, which would certainly destroy the aesthetics of the design.

As was stated before, the module and icosahedron could be formed out of any plastic material by injection molding or its equivalent, or it could be cut from any workable material like wood, or it could be constructed out of an assemblage of component parts be they plastic, wood, metal, cardboard or any of a multitude of diverse materials.

I have attempted to include as many variations of the invention as was proper in the specification. These variations are intended to be descriptive rather than merely limiting — especially in view of any further variation which the claims encompass but is not mentioned in the specification for lack of space or obviousness.

I claim:

1. A toy block of convex-concave design which when joined to at least one identical block and an icosahedron block with surface edges identical in length to convex surface edges on said toy block, convex surfaces to concave surfaces, forms a surface pattern of at least a double truncated icosahedron that is joined along its planes of truncation to single truncated icosahedra, the truncations being formed by removal of a cluster of five icosahedral faces which form a pentangular pyramid about a vertex, said double truncated icosahedron being truncated about at least two non-adjacent and non-opposing vertices.

2. A toy block of convex-concave design as claimed in claim 1 in which the convex surface is identical to a surface on an icosahedron from which one pentangular pyramid has been removed by a planar truncation, and in which the concave surface is located where the pentangular pyramid has been removed and is of such a degree of concavity that when a wholly convex surface surrounding a vertex on a similar block is fitted within it, a set of pentangular co-planar edges on each block are made tangent to one another.

3. A toy block of convex-concave design as claimed in claim 2 having means of connection to other identical blocks and an analogous icosahedron block.

4. A toy block of convex-concave design as claimed in claim 3 in which said means of connection occur at all wholly convex vertices and at the concave surface's center, said means of connection are apertures into which pins may be inserted and secured and used to secure other said identical blocks and said analogous icosahedron block in a tangential manner.

5. A toy block of convex-concave design as claimed in claim 3 in which said means of connection occur at all wholly convex vertices and at the concave surface's center, said means of connection occurring at each of the wholly convex vertices is an aperture, and said means of connection occurring at the center of the concave surface is a male connector which may be inserted into any of said apertures on any one of the other blocks so as to secure the two of them in a tangential manner.

6. A toy block of convex-concave design as claimed in claim 1 in which the convex surface is identical to a surface on a regular icosahedron from which one pentangular pyramid has been removed by a planar truncation, and in which the concave surface is located where the pentangular pyramid has been removed and is in the form of a cluster of five equilateral triangular surfaces whose combined apices form a wholly concave vertex and whose combined bases help form a pentangular co-planar and acutely convex edge on the surface of the block.

7. A toy block of convex-concave design as claimed in claim 6 having means of connection to other identical blocks and an analogous icosahedron block.

8. A toy block of convex-concave design as claimed in claim 7 in which said means of connection occur at all wholly convex vertices and at the wholly concave vertex, said means of connection are apertures into which pins may be inserted and secured and used to secure other said identical blocks and said analogous icosahedron block in a tangential manner.

9. A toy block of convex-concave design as claimed in claim 7 in which said means of connection occur at all wholly convex vertices and at the wholly concave vertex, said means of connection occurring at each of the wholly convex vertices is an aperture, and said means of connection occurring at the wholly concave vertex is a male connector which may be inserted into any of said apertures on any one of the other blocks so as to secure the two of them in a tangential manner.

10. A toy block of convex-concave design as claimed in claim 1 in which the convex surface is identical to a surface on a regular icosahedron from which one pentangular pyramid has been removed by a planar truncation, and in which the concave surface is located where the pentangular pyramid has been removed an is in the form of a cluster of five identical isoceles triangular surfaces, the individual isoceles triangular surfaces having bases identical in length to edges on said convex surface, and having sides slightly longer than the edges on said convex surface; whose combined apices form a wholly concave vertex and whose combined bases help form a pentangular co-planar and acutely convex edge on the surface of the block.

11. A toy block of convex-concave design as claimed in claim 10 having means of connection to other identical blocks and an analogous icosahedron block.

12. A toy block of convex-concave design as claimed in claim 11 in which said means of connection occur at all wholly convex vertices and at the wholly concave vertex, said means of connection are apertures into which pins may be inserted and secured and used to secure other said identical blocks and said analogous icosahedron block in a tangential manner.

13. A toy block of convex-concave design as claimed in claim 11 in which said means of connection occur at all wholly convex vertices and at the wholly concave vertex, said means of connection occurring at each of the wholly convex vertices is an aperture, and said means of connection occurring at the wholly concave vertex is a male connector which may be inserted into any of said apertures on any one of the other blocks so as to secure the two of them in a tangential manner.

14. A toy block of convex-concave design as claimed in claim 2 and an analogous icosahedron block which when joined to one another, concave surface to convex surface, form a surface pattern of two intersecting identical icosahedra, the intersections occurring in such a way that a pentangular co-planar line segment which forms a base of a cluster of five icosahedral faces about a vertex on each icosahedron is shared by the intersecting icosahedra along with a 10-sided polyhedron composed of triangular faces.

* * * * *